United States Patent [19]

Smith et al.

[11] Patent Number: 4,507,529

[45] Date of Patent: Mar. 26, 1985

[54] FOOD EMISSION SENSING

[75] Inventors: Peter H. Smith, Louisville, Ky.; Fred F. Holub, Schenectady, N.Y.

[73] Assignee: General Electric Company, Louisville, Ky.

[21] Appl. No.: 508,730

[22] Filed: Jun. 29, 1983

[51] Int. Cl.[3] ..... H05B 6/64

[52] U.S. Cl. ..... 219/10.55 A; 219/10.55 R; 219/396; 219/10.55 B

[58] Field of Search ..... 219/10.55 B, 10.55 F, 219/10.55 B, 10.55 R, 10.55 M, 10.55 D, 396; 338/34, 35; 324/65 R; 126/21 A

[56] References Cited

U.S. PATENT DOCUMENTS

| | | | |
|---|---|---|---|
| 2,862,095 | 11/1958 | Scofield | 219/35 |
| 3,459,921 | 8/1969 | Fussell et al. | 219/396 |
| 3,536,457 | 10/1970 | Henderson | 23/288 |
| 4,080,564 | 3/1978 | Nitta et al. | 324/65 R |
| 4,097,707 | 6/1978 | Kobayashi et al. | 219/10.55 B |
| 4,132,878 | 1/1979 | Tachikawa et al. | 219/10.55 B |
| 4,133,995 | 1/1979 | Buck | 219/10.55 M |
| 4,162,381 | 7/1979 | Buck | 219/10.55 B |
| 4,295,028 | 10/1981 | Tanabe | 219/10.55 B |
| 4,311,895 | 1/1982 | Tanabe | 219/10.55 B |
| 4,316,068 | 2/1982 | Tanabe | 219/10.55 B |
| 4,319,110 | 3/1982 | Tanabe et al. | 219/10.55 B |
| 4,336,433 | 6/1982 | Yokozeki | 219/10.55 B |
| 4,410,779 | 10/1983 | Weiss | 219/10.55 F |

FOREIGN PATENT DOCUMENTS

| | | |
|---|---|---|
| 54-43347 | 5/1979 | Japan . |
| 55-110835 | 8/1980 | Japan . |
| 55-112937 | 9/1980 | Japan . |
| 2035767 | 10/1979 | United Kingdom . |

*Primary Examiner*—Roy N. Envall, Jr.
*Assistant Examiner*—Marvin M. Lateef
*Attorney, Agent, or Firm*—H. Neil Houser; Radford M. Reams

[57] ABSTRACT

A microwave oven having a cooking cavity for receiving objects to be heated during the oven cooking cycle arranged to permit continuous circulation of air through the cavity during the cooking cycle, an exhaust flow path to the oven exterior formed externally of the cavity for circulating air exiting the cavity, and sensing means responsive to vapors and/or gases carried by the exiting air positioned in the exhaust flow path, is provided with a pyrolytic converter positioned in the exhaust flow path upstream of the sensing means for converting non-gaseous contaminants carried by the exiting air during the cooking cycle to gaseous form. Removal of non-gaseous contaminants from the air exiting the cooking cavity upstream of the sensor prevents accumulation of such contaminants from interferring with proper sensor operation without interrupting the cooking cycle and without requiring periodic manual cleaning of the sensor device.

11 Claims, 6 Drawing Figures

FOOD EMISSION SENSING

BACKGROUND OF THE INVENTION

The present invention relates to a microwave cooking oven and more specifically to an improved arrangement for preventing contamination of a sensor used to sensing gaseous emissions from food during the cooking cycle.

It is now well known in the art to employ sensing devices responsive to gases or humidity in the air exiting the cooking cavity for controlling the duration of the cooking cycle. Representative schemes for using such sensing devices are described in U.S. Pat. No. 4,336,433 and U.S. Pat. No. 4,311,895. The former describes a system utilizing a humidity sensor and the latter describes a system using a gas sensor. Use of either type of sensing device requires that the device be exposed to the air exiting the cooking cavity. This exiting air carries various organic fatty compounds emitted from the food which tend to accumulate on the sensor so as to hinder its proper operation. For example, during the roasting of meats, fats in the vapor phase are released together with steam. These fats tend to collect on the sensor element producing an impermeable barrier to the water vapor or other gaseous constituents.

One approach, described in U.S. Pat. No. 4,080,564, employed with humidity sensors for such applications is to provide a heating resistor in close proximity to the sensor element which is periodically energized during the cooking cycle to burn off contaminants which have accumulated on the sensor surface. This arrangement satisfactorily cleans the sensor. However, it is necessary to suspend heating of the food in the cavity during the cleaning intervals since the sensor is inoperative during these intervals resulting in prolonged cooking cycles. It has been determined that for satisfactory operation, a cleaning interval of up to one minute duration may be necessary. In addition, the rate of contaminant accumulation, particularly for food items high in fat and starch content, may necessitate cleaning intervals as often as every 9 minutes for satisfactory operation. Thus, each hour of actual cooking time could require an additional 6–7 minutes of cleaning time.

One preventive approach employed with a gas sensor is to enclose the sensor within a fine mesh screen. However, over time a barrier of contaminants will accumulate on the screen, necessitating periodic removal for cleaning. Another approach, described in Japanese Pat. No. 55-112937, provides for mounting the sensor for periodic movement into the exit air path for sensing. This slows contaminant accumulation but would still require eventual cleaning. Also, the mounting arrangement adds cost and adversely impacts reliability.

It is apparent from the foregoing that an arrangement which prevents the airborne contaminants from interferring with sensor operation without interruption of the cooking cycle resulting in prolonged cycle times, and which does not require periodic cleaning of the sensor device by the user, is desirable.

It is a primary object of the present invention to provide in a microwave oven employing a sensor for detecting gaseous food emissions an improved sensor arrangement which protects the sensor from contaminant accumulation without interrupting or altering the cooking cycle and which does not require periodic user intervention.

It is a further object of the invention to provide in such an oven means upstream of the sensing device for converting airborne nongaseous contaminants to gaseous form to prevent accumulation of such contaminants on the sensing device.

It is a further object of the invention to provide in such an oven pyrolytic conversion means for removing by pyrolysis non-gaseous airborne contaminants from the air stream flowing over the sensor.

It is a further object of the invention to provide in an oven of the aforementioned type cooling means interposed between the pyrolytic conversion means and the sensor to cool the air heated by the pyrolytic means to a predetermined temperature before the air reaches the sensor.

SUMMARY OF THE INVENTION

In accordance with the present invention, a microwave oven having a cooking cavity for receiving objects to be heated during the oven cooking cycle with an air inlet formed in one wall thereof and an air exit formed in another wall thereof for permitting a continuous circulation of air through the cavity, an exhaust flow path to the exterior formed externally of the cavity for air exiting the cavity through the exit, and sensing means responsive to vapors and/or gases carried by the exiting air positioned in the exhaust flow path, is provided with conversion means positioned in the exhaust flow path upstream of the sensing means for converting non-gaseous contaminants carried by the exiting air during the cooking cycle to gaseous form.

In accordance with one aspect of the invention, the conversion means comprises pyrolytic means for removing non-gaseous contaminants from the air by pyrolysis. Cooling means is interposed in the flow path between the pyrolytic means and the sensing means to cool the air heated by the pyrolytic means to the desired temperature range for satisfactory sensor operation.

In accordance with yet another aspect of the invention, the hollow rectangular waveguide of the microwave excitation system also provides a portion of a cool air channel for providing cooling air to the cooling means. A portion of the exterior air drawn into the oven for magnetron cooling is diverted to the waveguide and directed via the waveguide to the cooling means. The cooling means comprises a first set of cooling fins extending into the exhaust flow path intermediate the pyrolytic means as the sensing means and a second set of fins external of the flow path in heat exchange contact with the first set. Cooling air from the waveguide is directed over the second set of fins.

Removal of non-gaseous contaminants from the air exiting the cooking cavity upstream of the sensor in accordance with the hereinbefore summarized invention prevents accumulation of such contaminants from interferring with proper sensor operation without interrupting the cooking cycle and without requiring periodic manual cleaning of the sensor device. Use of pyrolysis provides a further advantage in that the reduction of non-gaseous contaminants emitted by the food to sensor detectable gaseous constitutents before the food being cooked is heated sufficiently to emit such gases directly, expands the temperature range for the sensor based cook cycle control.

BRIEF DESCRIPTION OF THE DRAWINGS

While the novel features of the invention are set forth with particularity in the appended claims, understanding and appreciation of the invention will be enhanced by the following detailed description taken in conjunction with the drawings in which:

DETAILED DESCRIPTION OF THE INVENTION

Figure 1:
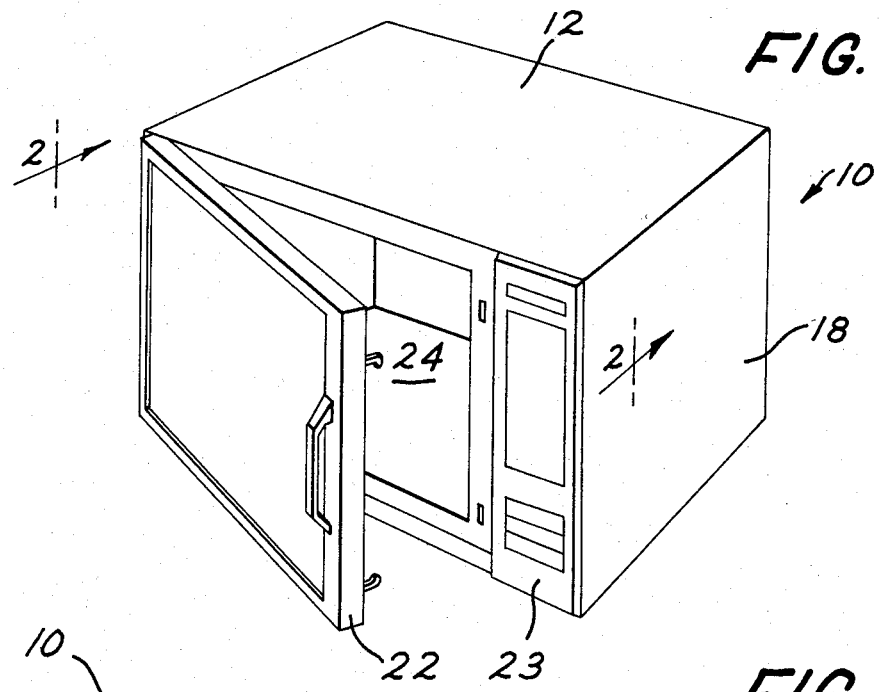
FIG. 1 is a perspective view of a microwave oven illustratively embodying the invention.
Figure 3:
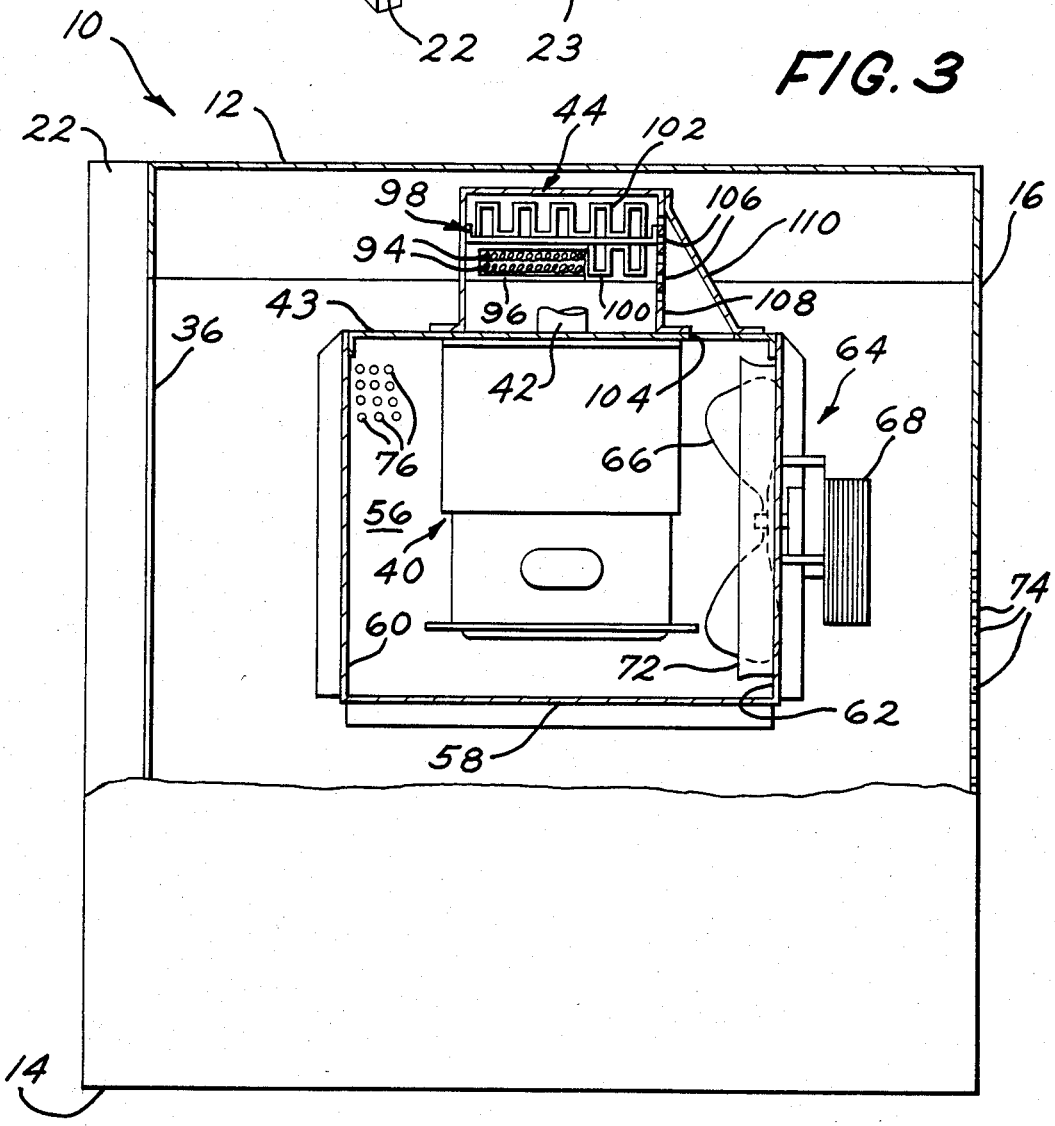
FIG. 3 is a schematic side view of the microwave oven of FIG. 1, partially in section, with portions removed to illustrate structural details.
Figure 2:
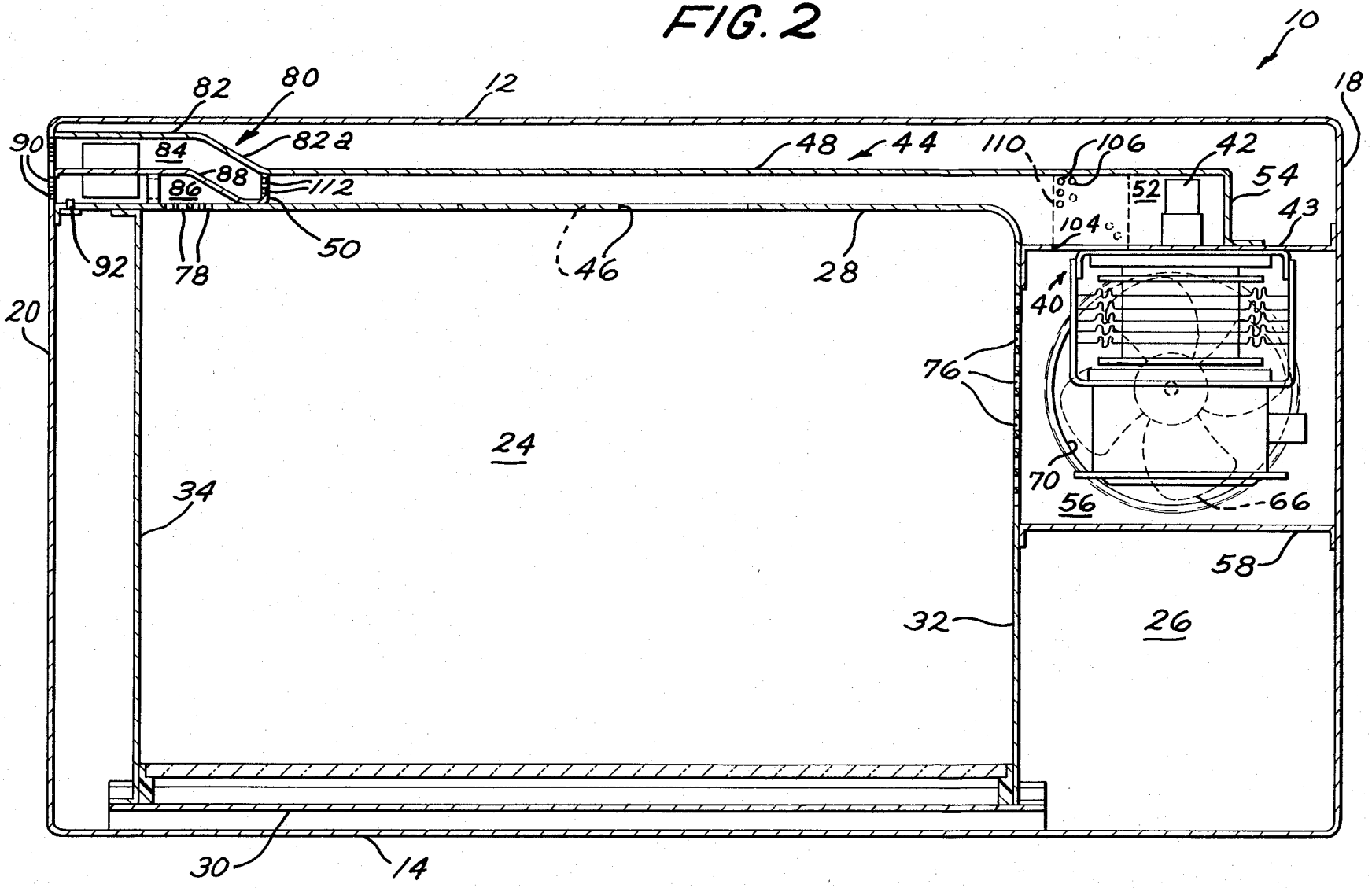
FIG. 2 is a front schematic sectional view of the microwave oven of FIG. 1 taken along lines 2—2.
Figure 4:
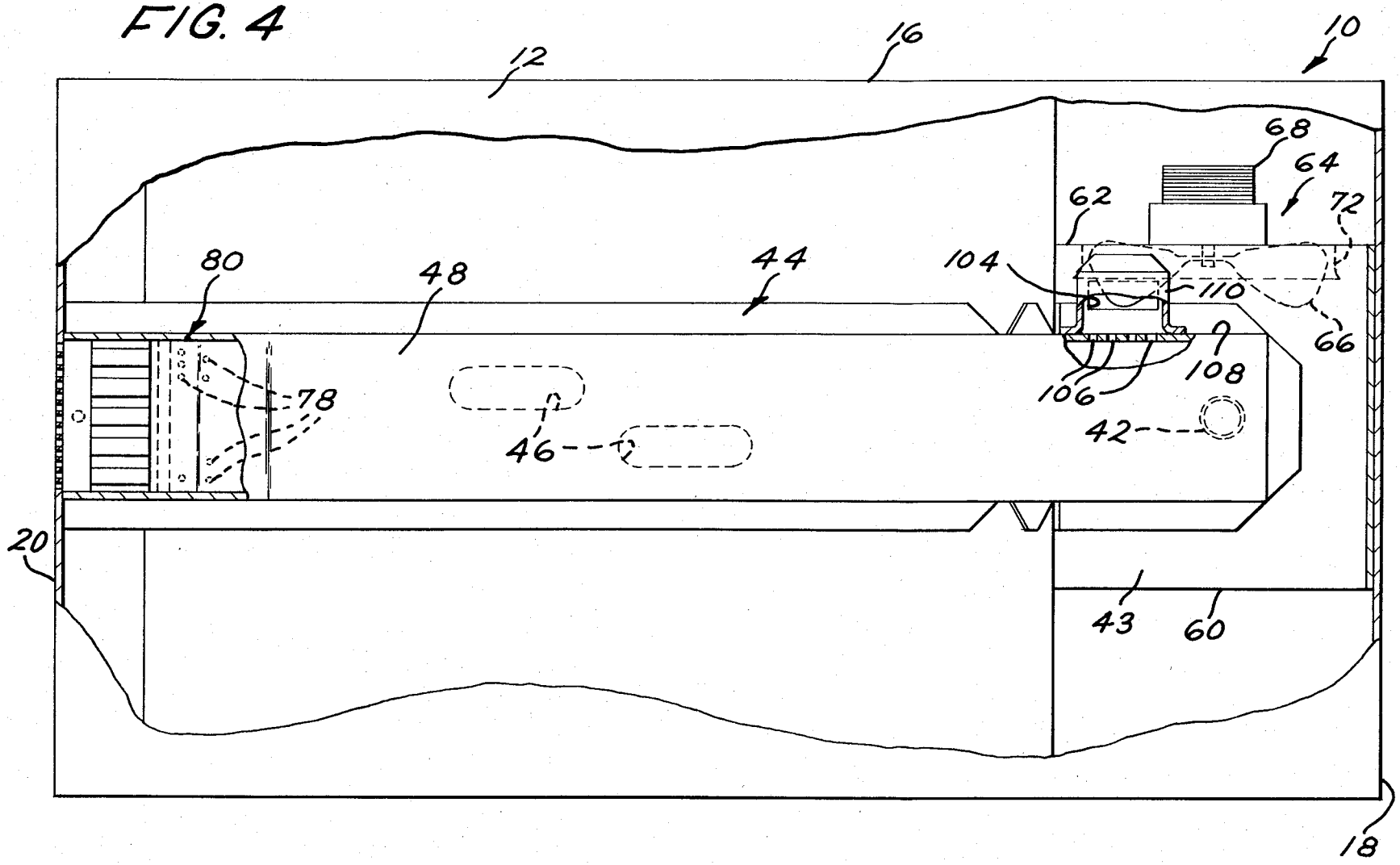
FIG. 4 is a schematic top view of the microwave oven of FIG. 1 with portions removed to illustrate structural details.

Referring to FIGS. 1-4, there is shown a microwave oven designated generally 10. The outer cabinet comprises six cabinet walls including upper and lower walls 12 and 14, respectively, rear wall 16, two side walls 18 and 20 and a front wall partly formed by hingedly supported door 22 and partly by control panel 23. The space inside the outer cabinet is divided generally into a cooling cavity 24 and a controls compartment 26. The cooking cavity includes top wall 28, a bottom wall 30, side walls 32 and 34, the rear cavity wall being cabinet wall 16 and the front cavity wall being defined by the inner face 36 of door 22. The front facing opening of control compartment 26 is enclosed by control panel 23.

Controls compartment 26 has mounted therein a magnetron 40 adapted to produce microwave energy having a center frequency of approximately 2450 MHz at output probe 42 thereof when coupled to a suitable source of power (not shown) such as the 120 volt AC power supply typically provided at domestic wall outlet receptacles. Magnetron 40 is supported from planar support member 43 extending between cavity side wall 32 and cabinet side wall 18.

Microwave energy from magnetron output probe 42 of magnetron 40 is coupled to cooking cavity 24 via rectangular feed waveguide 44 which extends generally centrally along the upper cavity wall 28. Energy is transmitted from waveguide 44 to cooking cavity 24 via coupling apertures 46 formed in cavity wall 28. Apertures 46 are shown as being physically open slots but may alternatively be closed by materials known in the art to be pervious to microwave energy. Waveguide 44 is of generally rectangular cross section being formed by member 48 having a generally U-shaped cross section which is attached by suitable means such as welding to the top cavity wall 28 which forms a common wall for waveguide 44 and cavity 24. Conductive end wall 50 provides a short circuit termination for waveguide 44 remote from magnetron 40. Waveguide 44 is dimensioned to support a $TE_{10}$ propagating mode with a nominal height of 0.75 inches and a nominal width of 3.66 inches. Waveguide 44 also includes an energy launching area 52 which encloses magnetron probe 42. Conductive wall 54 spaced approximately ¾ inch from probe 42 serves as a short circuit termination for area 52. A portion of support member 43 defines the bottom of launch area 52.

A cooling air plenum 56 substantially enclosing magnetron 40 is bounded beneath by bottom plenum wall 58 extending beneath magnetron 40 between cavity side wall 32 and cabinet side wall 18, bounded on the sides by plenum front wall 60, plenum rear wall 62 and portions of cavity side wall 32 and cabinet side wall 18 and bounded above by support member 43. A blower for magnetron cooling designated generally 64 comprises a fan 66 driven by an electric motor 68. Blower 64 is mounted in a circular opening 70 in plenum rear wall 62. An annular shroud 72 surrounds fan 66. Perforations 74 formed in rear cabinet wall 16 permit cooling air from outside the outer cabinet to be drawn into plenum 56 by blower 64. Entry ventilation holes 76 formed in cavity side wall 32 permit ventilating air from plenum 56 to enter cooking cavity 24. The gauge and density of ventilation holes 76 is selected to permit the desired volume of ventilating air to flow from plenum 56 into cooking cavity 24. The air entering cavity 24 circulates through cooking cavity 24 combining with the gases, vapors and particulates emitted by the food being cooked. The ventilating air then exits cavity 24 via exit holes 78 formed in upper cavity wall 28 near the upper left corner of cavity 24.

The basic elements of microwave 10 described hereinbefore are of conventional design well known in the art. It will be understood that numerous components are required in a complete microwave oven but, for clarity of illustration and description, only those elements believed essential for a proper understanding of the present invention are shown and described. Such other elements including electronic control circuitry may all be conventional and, as such, are well known to those skilled in the art. A detailed description will now be given of the novel arrangement embodied in microwave oven 10 for preventing contamination of a sensor used for controlling certain cooking cycles performed by oven 10.

As briefly described hereinbefore, circulating air enters cooking cavity 24 via entry ventilation holes 76. Inside cavity 24 as the cooking cycle progresses, various gases laden with moisture and other non-gaseous contaminants, including fats and starches emitted by the food being cooked, are carried by the circulating air out of cavity 24 via air exit openings 78 formed in the upper left region of top cavity wall 28. In accordance with the present invention, conversion means are disposed in the flow path of air exiting via openings 78 to convert airborne contaminants to gaseous form upstream of a sensor responsive to gaseous constitutents of the air.

Figure 5:
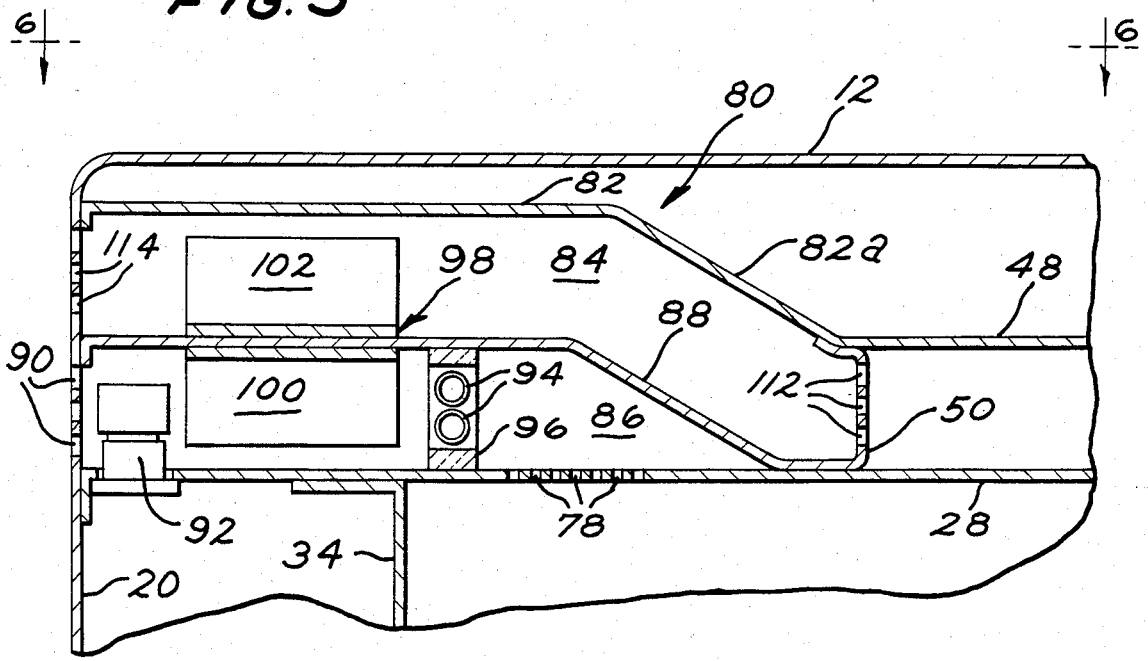
FIG. 5 is a partial enlarged front sectional view of the microwave oven of FIG. 1 with portions removed to show structural details of the pyrolytic means and associated cooling means.
Figure 6:
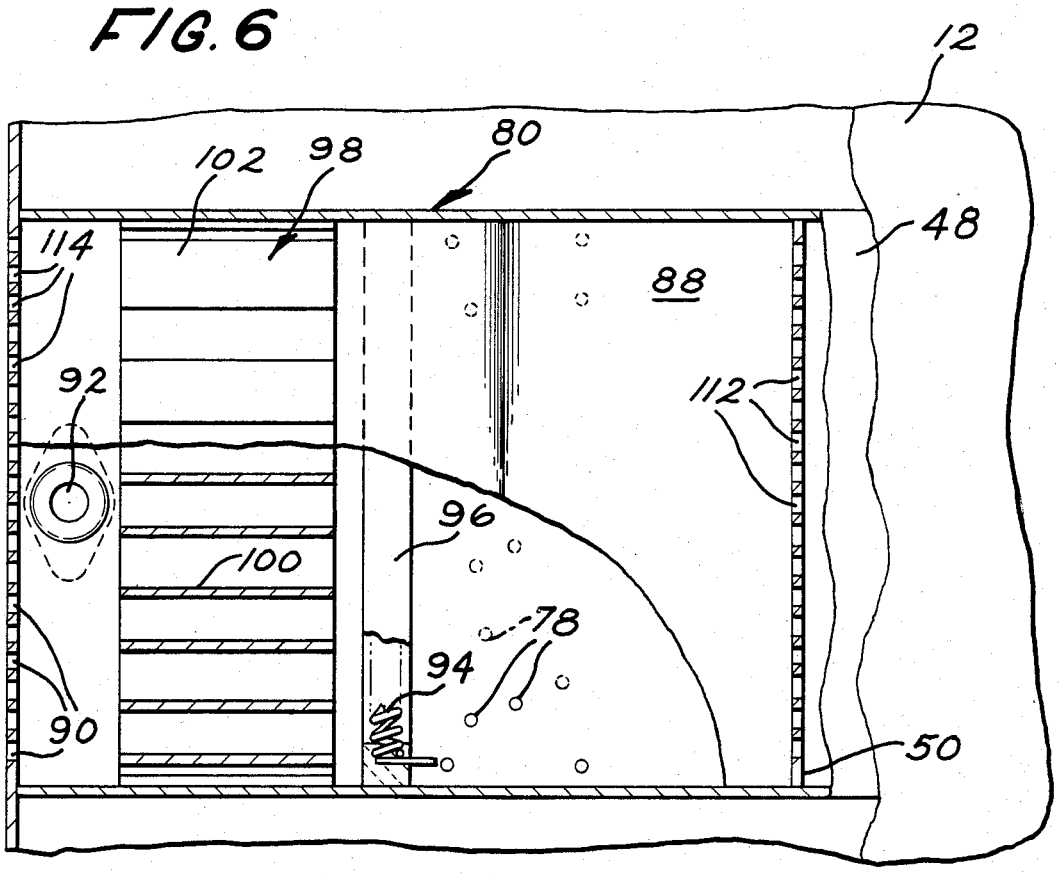
FIG. 6 is a partial enlarged top sectional view of the microwave of FIG. 1 with portions removed to show structural details of the pyrolytic means and associated cooling means.

As best seen in FIGS. 5 and 6, the conversion means of the illustrative embodiment includes a chamber 80 formed by an extension 82 of waveguide member 48, and portions of top cavity wall 28 and cabinet side wall 20. Extension 82 includes an upwardly sloping section 82*a* to provide a sufficient height in chamber 80. The interior of chamber 80 is divided into upper and lower regions 84 and 86, respectively, by partition 88 which extends between waveguide end wall 50 and cabinet side wall 20 generally parallel to the top wall forming portion of extension 82.

Lower region 86 defines an air passageway or channelized air space which provides an exhaust flow path from cavity 24 to the exterior of the oven cabinet extending between ventilation exit holes 78 formed in cavity top wall 28 and outlet holes 90 formed in cabinet side wall 20.

Sensing means 92 is positioned in this flow path to respond to various gaseous constituents and moisture in the air passing therethrough. In the illustrative embodiment, sensing means 92 comprises a gas sensor of the type readily available from Figaro Engineering, Inc., identifiable as Model TGS No. 186. This sensor is sensitive to various gases, temperature and humidity.

Information regarding the constituents of the exiting air derived from sensor 92 may be used to automatically control the duration of the cooking cycle. An example of such a control arrangement may be found in U.S. Pat. No. 4,336,433. The control arrangement therein disclosed uses a humidity sensor, but the basic control principles therein described may be readily adaptable to a gas sensor of the Figaro type.

In the illustrative form of the invention herein described, the conversion is by pyrolysis. Pyrolytic means is provided in the form of a pair of resistive heating coils 94 mounted in an open ceramic frame 96. Coils 94 extend across the first air passageway 86 such that air flowing in the passageway passes over the heating coils. The power rating for coils 94 is selected to heat the air passing over coils 94 to a temperature sufficient to reduce contaminants in the air to water vapor, carbon dioxide gas and residual ash. Satisfactory pyrolytic action is achieved when the air is heated to temperatures in excess of 600° C. Coils with a power rating of 10 watts have been found suitable with air flow rates in the order of $\frac{1}{2}$ $ft^3$/hour.

The preferred operating temperature for sensor 92 is on the order of 30° C. Having elevated the temperature of the air in passageway 86 to remove contaminants, it remains to bring the temperature of the air approaching sensor 92 back down to this desired sensor operating temperature range. To this end a cooling means, designated generally 98, is interposed between heating coils 94 and sensor 92. In the illustrative embodiment, cooling means 98 comprises a first set of cooling fins 100 projecting into air passageway 86 and a second set of cooling fins 102 mounted externally of passageway 86 in heat exchange contact with fins 100. Fins 100 are formed of corrugated sheet metal secured to partition 88 with corrugations extending substantially parallel to the direction of air flow in passageway 86. Cooling fins 102 are similarly formed of corrugated sheet metal and extend into upper portion 84 of conversion chamber 80 suitably secured to the opposite face of sheet metal partition 88 such that fins 102 are in good heat exchange contact with fins 100. Heat from the air passing over fins 100 is transferred by conduction to fins 102. Fins 102 are cooled by circulating cooling air from plenum 56 over them. To this end, a second channelized air space formed in part by waveguide 44 and in part by upper region 84 of chamber 80 delivers cooling air to fins 102 from plenum 56. An air communication path from plenum 56 to waveguide 44 includes aperture 104 formed in upper plenum wall 43, openings 106 in side wall 108 of waveguide 44 and duct member 110 which extends at an angle between waveguide side wall 108 and the upper plenum wall 43.

As described hereinbefore, the major portion of outside air drawn into planum 56 circulates about magnetron 40 and enters cooking cavity 24 via entry ventilation holes 76. However, blower 64 generates a greater volume of high pressure air than can be passed through ventilation holes 76 into cavity 24. Consequently, the pressure buildup in plenum 56 causes a portion of the exterior air entering the plenum to be diverted through aperture 104 before encountering magnetron 40, which air is directed into waveguide 44 via openings 106 by duct member 110.

Cooling air from plenum 56 flows down waveguide 44, exits waveguide 44 via openings 112 in end wall 50, passes over cooling fins 102, removing heat therefrom and exits the oven via exit holes 114 formed in cabinet side wall 20. This arrangement advantageously utilizes waveguide 44 to also function as a substantial portion of the cooling air path, thereby delivering cooling air to the conversion means without need for additional air flow structure.

It will be apparent from the foregoing description that the present invention provides an effective arrangement for preventing organic contaminant accumulation on the sensor throughout the cooking cycle without need for interruption of the cooking cycle and without requiring any extensive structural modifications to present oven designs. In addition to accomplishing the primary objective of contaminant removal, further advantages result from the pyrolytic removal of contaminants because the by-products of the pyrolytic action on organic contaminants include water vapor, carbon dioxide and other gases to which sensor 92 is responsive. The organic contaminants are released from foods at lower temperatures than water vapor. By converting the organic contaminants to gases detectable by the sensor, sensor based automatic control of the cooking cycle can be implemented earlier in the cooking cycle before foods are hot enough to provide sufficient emissions in gaseous form. Thus, pyrolytic conversion enables control of cooking as a function of airborne emissions over a greater food temperature range.

While a specific embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A microwave oven comprising:

a cooking cavity for receiving objects to be heated during the oven cooking cycle;

means for providing a continuous circulation of air through said cavity during the cooking cycle whereby contaminants emitted from the objects being heated become entrained in the circulating air, said air circulation providing means including exit means for permitting the circulating air to exit said cavity;

air channeling means formed externally of said cavity defining an exhaust flow path to the exterior for air exiting said cavity via said exit means;

sensing means positioned in said exhaust flow path responsive to gaseous constitutents of the air passing therethrough; and conversion means positioned in said flow path upstream of said sensing means for converting non-gaseous contaminants carried by the air to gaseous form during the cooking cycle; whereby accumulation of non-gaseous contaminants on said sensing means is prevented.

2. The microwave oven of claim 1 further comprising cooling means interposed in said flow path between said conversion means and said sensing means, for cooling the air passing from said conversion means to said sensing means.

3. The microwave oven of claim 2 wherein said conversion means comprises pyrolytic means for converting said contaminants in the air by pyrolysis.

4. A microwave oven comprising:

a cooking cavity for receiving objects to be heated during the oven cooking cycle, including a top wall, a bottom wall and side walls;

a microwave energy source mounted externally of said cavity;

rectangular waveguide means for coupling microwave energy from said source to said cavity;

blower means for directing cooling air from outside of the oven to said energy source;

one of said cavity walls having formed therein an air inlet and another of said cavity walls having formed therein an air exit, said inlet and exit permitting a portion of said cooling air to circulate through said cooking cavity, whereby contaminants emitted from objects being heated become entrained in the circulating air;

a first channelized air space formed externally of said cooking cavity for guiding air exiting said cavity via said exit to the exterior of said oven;

sensing means positioned in said first air space responsive to gaseous constituents in the air passing therethrough; and pyrolytic conversion means positioned in said first air space upstream of said sensing means for converting contaminants from the air by pyrolysis during the cooking cycle, thereby preventing the accumulation of contaminants on said sensing means.

5. The microwave oven of claim 4 further comprising cooling means for cooling the air flowing between said pyrolytic conversion means and said sensing means.

6. The microwave oven of claim 5 further comprising a second channelized air space for guiding a portion of said cooling air to said cooling means, said second air space being formed at least in part by said waveguide means.

7. The microwave oven of claim 5 further comprising a second channelized air space formed externally of said cavity and separate from said first air space, means positioned between said energy source and said blower means for enabling a portion of the cooling air directed by said blower means to enter said second air space, and wherein said cooling means further comprises a first set of heat exchange members extending inwardly of said first air space in heat exchange contact with the air flowing between said pyrolytic conversion oven and said sensing means; and a second set of heat exchange members in thermal contact with said first set, and extending into said second air space whereby heat is conducted from said first set to said second set of heat exchange members and air flowing through said second air space carries heat from said second set of heat exchanger members.

8. The microwave oven of claim 7 wherein said waveguide defines a portion of said second channelized air space, said waveguide having formed near one end thereof an air entryway and formed remote therefrom an air outlet, said air entryway being in air communication with said enabling means and wherein said second air space is further defined by channel means for guiding air exiting said waveguide through said air outlet over said second set of said heat exchange members to remove heat therefrom.

9. The mircrowave oven of claim 8 wherein said pyrolytic conversion means comprises one or more resistive heater elements operative when energized to reach temperatures of at least approximately 600° C., and wherein said cooling means is operative to cool the air passing from said heating elements to said sensing means such that the temperature of air reaching said sensing means is lowered to approximately 30° C.

10. A microwave oven comprising:

a cooking cavity for receiving objects to be heated during the oven cooking cycle, including a top cavity wall, a bottom cavity wall, and a plurality of side walls;

a microwave energy source mounted externally of said cavity;

blower means for directing cooling air to said energy source;

one of said cavity walls having formed therein an air inlet, another of said side walls having formed therein an air exit, said inlet and exit permitting a portion of said cooling air circulating around said energy source to circulate through said cooking cavity whereby contaminants emitted from objects being heated in said cavity become entrained in the circulating air;

a first channelized air space formed externally of said cooking cavity for guiding air exiting said cavity via said exit to the exterior of said oven;

sensing means positioned in said first air space responsive to gaseous constituents of the air passing therethrough;

pyrolytic conversion means positioned in said first air space upstream of said sensing means for converting non-gaseous contaminants from said air by pyrolysis during the cooking cycle;

cooling means for cooling air passing from said pyrolytic conversion means to said sensing means comprising a first set of heat exchange members extending into said first space for removing heat from said air; and a second set of heat exchange members located externally of said first space in thermal communication with said first set for conducting heat therefrom;

a second channelized air space formed externally of said cavity separate from said first air space for guiding cooling air over said second set of heat exchange members to remove heat therefrom; and means for diverting a portion of the cooling air directed toward said energy source by said blower means upstream of said energy source into said second air space;

whereby non-gaseous contaminants entrained in the circulating air exiting said cavity are pyrolyzed to prevent accumulation on said sensing means, and the resultant gases are cooled to facilitate sensor operation.

11. The microwave oven of claim 10 wherein said waveguide means comprises a hollow rectangular waveguide extending externally of said cavity along one wall thereof and disposed to define a portion of said second air space; said waveguide having formed therein an air entry way relatively near said energy source and an air outlet relatively remote therefrom, and said means for diverting air being constructed and arranged to divert said portion of cooling air into said waveguide through said air entry way; said second air space further comprising air duct means for guiding air exiting said waveguide air outlet over said second heat exchange members to carry heat therefrom to the exterior of the mircowave oven.

* * * * *